United States Patent [19]

Haraguchi

[11] Patent Number: 4,951,786

[45] Date of Patent: Aug. 28, 1990

[54] LOAD DISTRIBUTION DETECTING SYSTEM FOR ELEVATOR

[75] Inventor: Hitoshi Haraguchi, Narita, Japan

[73] Assignee: Otis Elevator Company, Farmington, Conn.

[21] Appl. No.: 362,115

[22] Filed: Jun. 6, 1989

[30] Foreign Application Priority Data

Jun. 9, 1988 [JP] Japan ..... 63-142383

[51] Int. Cl.[5] ..... B66B 9/00

[52] U.S. Cl. ..... 187/1 R; 187/28; 187/132; 187/139; 358/108

[58] Field of Search ..... 187/1 R, 130, 131, 132, 187/139, 28, 31, 39, 51; 358/93, 108; 340/825.28, 825.29

[56] References Cited

U.S. PATENT DOCUMENTS

| | | | |
|---|---|---|---|
| 2,602,524 | 7/1952 | Shirley | 187/139 |
| 3,543,883 | 12/1970 | Kuzara | 187/131 |
| 4,555,724 | 11/1985 | Enriquez | 187/131 |

*Primary Examiner*—H. Grant Skaggs
*Assistant Examiner*—Kenneth Noland
*Attorney, Agent, or Firm*—William W. Jones

[57] ABSTRACT

A load distribution detecting matrix is provided in the floor of an elevator cab. The elevator controller receives information from the matrix and can alter operation of the elevator in response to detection of predetermined load distribution characteristics.

7 Claims, 1 Drawing Sheet

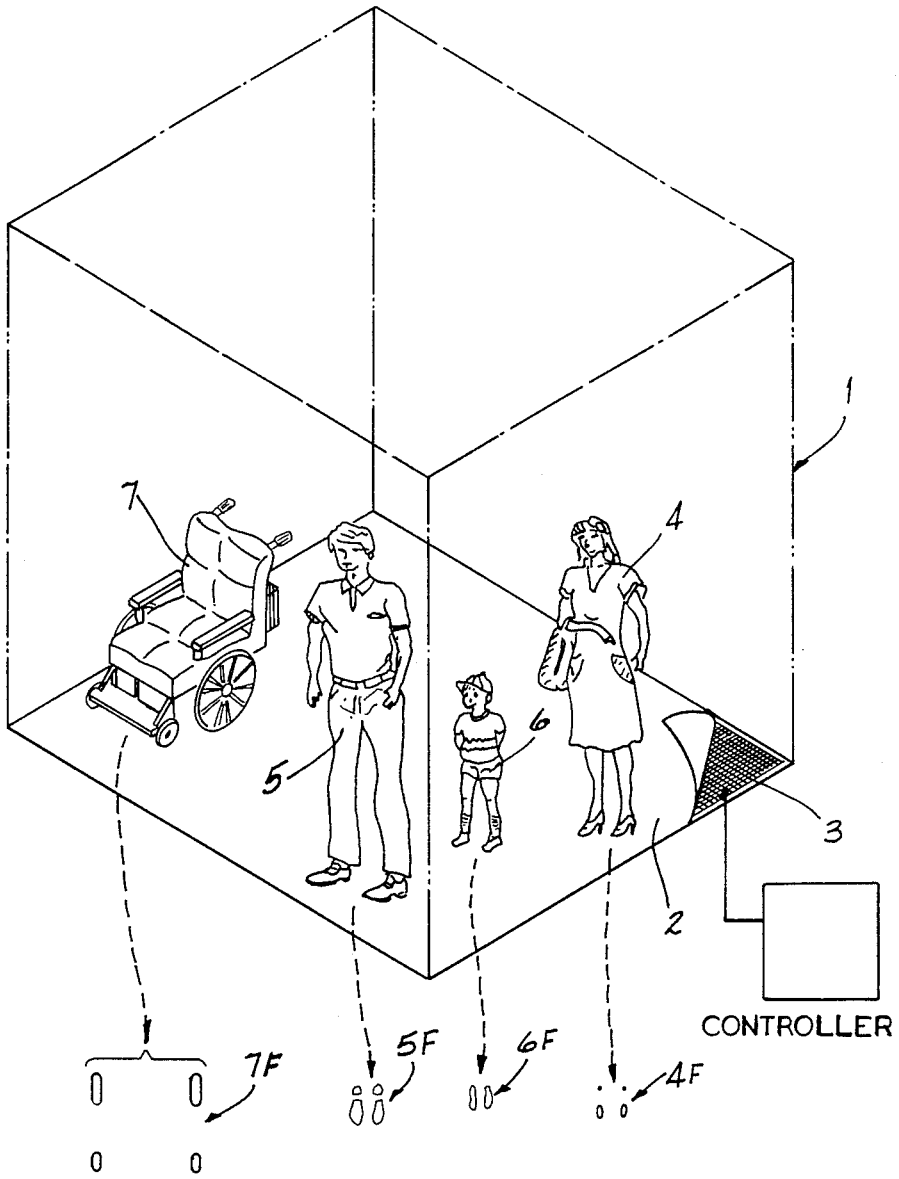
1
7
4
5
6
3
2
CONTROLLER
7F
5F
6F
4F

LOAD DISTRIBUTION DETECTING SYSTEM FOR ELEVATOR

TECHNICAL FIELD

The present invention broadly relates to control of an elevator and, particularly, to detection of passenger population and load distribution which can be used in the control of the elevator.

BACKGROUND ART

Hitherto, a control method for elevators has been proposed in which the control is conducted in accordance with the load magnitude which is detected by a strain gauge means disposed under the floor plate of the elevator cab so as to sense the load in terms of the weight of passengers. However, no proposal has been made heretofore which would detect the load distribution to determine characteristics or distribution of the load.

DISCLOSURE OF THE INVENTION

This invention relates to the provision of a load distribution and passenger population detecting system for an elevator, capable of detecting the passenger distribution and to some extent the nature of the passengers in the elevator.

According to the invention, there is provided a load distribution detecting system comprising load detection elements arranged in a matrix-like form on the floor of a space where passengers gather in the cab, so as to detect the shape and size of the area of contact between the passenger or passengers and to trace the movement of the area of contact in the cab in relation to time.

An embodiment of the invention will be described hereinafter with reference to the accompanying drawing which is a perspective view of a passenger group in a cab, and the signature each makes on the detector matrix.

Referring to the drawing, an elevator has a cab 1 (shown in phantom) having a floor 2 under which is laid a load distribution detecting device 3 composed of load detecting elements arranged in the form of a matrix. Numerals 4, 5 and 6 denote, respectively, a female passenger, a male passenger and a child. The shapes of the areas of contact between these passengers and the cage floor 2 are represented, respectively, by numerals 4F, 5F and 6F. A reference numeral 7 designates a wheeled chair which contacts the cage floor at areas 7F. The load detecting element is made of an electrically conductive rubber or constituted by a piezoelectric element. A multiplicity of such elements are arranged in the form of a matrix under the floor so that data concerning the passengers can be obtained in terms of coordinate values. The load distribution detecting device, when composed of conductive rubber elements, relies upon on-off action so that it cannot detect the level of the load although it is effective in detecting the shape of the load areas and the distribution of the same. In contrast, the load distribution detecting device composed of a matrix of piezoelectric elements can detect the shapes of the load areas, distribution of the load areas and also the levels of the load. Data concerning the shapes of the load areas and the distribution of the same enables the number of passengers and the type of the same (sex, discrimination between adult and child, wheeled chair, etc.) to be specified. These data, together with the data concerning the weight, are fed back to the elevator control system for the purpose of delicate and overall control of the power of the elevator.

The passenger data can be used by the door control software to selectively alter door operation, or by the speed control software to selectively change elevator speed, or by the floor control software to modify its mode of operation in unknown cases.

For example, it is often experienced that a child makes a mischief to press destination floor buttons at random to register many floors for stopping. In such a case, the load distribution detecting system detects that only a child is on the cage so that the mischief registration can be cancelled and a suitable measure is taken. For instance, the start of the cab could be inhibited with the door kept opened. In such a case, the door control software and the motor control software would be involved in the altered mode of operation.

When the load distribution detecting system has detected that a male passenger and a female passenger are on the cab and that the positions of the areas of contact between these passengers and the cab floor move to and fro in a random manner, a crime prevention mode of the elevator control is started so that the cab is forcibly stopped at the nearest floor and the door is opened while an alarm bell is activated. This would involve the door control software, the motor control software and an alarm program in the controls.

The presence of a wheeled chair 7 on the cage is detected through sensing the contact areas 7F. Arrival of the cage at the designated floor at which the handicapped person on the chair wishes to get off is detected through sensing the movement of the contact areas 7F. In such a case, the door open time is prolonged to enable the handicapped person to safely get off the cage. This handicapped mode of operation would involve the door control software.

As will be understood from the foregoing description, the load distribution detecting system of the present invention enables detailed data concerning the load on the elevator cage to realize a proper control of the cage movement. The software programming merely involves simple yes/no decisions to be made as to whether a preprogrammed condition exists in the cab. If "yes" then an attend operational mode ensues. If "no" then normal operation of the various control software continues.

What is claimed is:

1. An elevator control system for modifying operation of an elevator, said system comprising a matrix of sensor means associated with the floor of an elevator cab for detecting the location and shapes of loaded areas on the cab floor caused by passengers in the cab, and microprocessor means connected to said sensor means for altering elevator movement or door operation in response to reception of predetermined signal patterns from said sensor means signifying pre-inputted information relating to a type of passenger in the cab or a type of passenger movement in the cab.

2. The elevator control system of claim 1 wherein said sensor means is operable to detect the presence of a wheelchair in the cab, and wherein said microprocessor means is operable to delay cab door closing operation upon receipt of a wheelchair signal from said sensor means.

3. The elevator control system of claim 1 wherein said sensor means is operable to distinguish between adult male and adult female passengers in the cab.

4. The elevator control system of claim 3 wherein said sensor means is operable to detect random movement of adult male and female passengers in the cab, and said microprocessor means is operable to stop movement of the cab and open the cab and hall doors upon receipt of such a random movement signal from said sensor means.

5. The elevator control system of claim 1 wherein said sensor means is operable to distinguish between adult and children passengers in the cab.

6. The elevator control system of claim 5 wherein said microprocessor means is operable to detect multiple floor selector button actuation arising when one or more children are detected by said sensor means as the sole passengers in said cab whereupon said microprocessor means is operable to cancel all but one floor selection and retain said cab at said floor until the children exit said cab.

7. The elevator control system of claim 1 wherein said sensor means is further operable to detect the level of load in said loaded areas.

* * * * *